US007067971B2

(12) United States Patent
Taniguchi et al.

(10) Patent No.: US 7,067,971 B2
(45) Date of Patent: Jun. 27, 2006

(54) FIELD EMISSION ELEMENT

(75) Inventors: Masateru Taniguchi, Chiba (JP); Manabu Kitada, Chiba (JP); Kazuhito Nakamura, Chiba (JP); Satoru Kawata, Chiba (JP)

(73) Assignee: Futaba Corporation, Chiba (JP)

( * ) Notice: Subject to any disclaimer, the term of this patent is extended or adjusted under 35 U.S.C. 154(b) by 0 days.

(21) Appl. No.: 10/900,124

(22) Filed: Jul. 28, 2004

(65) Prior Publication Data

US 2005/0029922 A1 Feb. 10, 2005

(30) Foreign Application Priority Data

Aug. 4, 2003 (JP) ..... 2003-285874

(51) Int. Cl.
*H01J 1/62* (2006.01)

(52) U.S. Cl. ..... 313/497; 313/495; 313/496

(58) Field of Classification Search ..... 313/306–309, 313/495–497, 311, 336, 351, 355
See application file for complete search history.

(56) References Cited

U.S. PATENT DOCUMENTS

| | | | | |
|---|---|---|---|---|
| 5,818,166 | A * | 10/1998 | Karpov et al. | 313/495 |
| 6,215,243 | B1 * | 4/2001 | Janning | 313/496 |
| 6,455,989 | B1 * | 9/2002 | Nakada et al. | 313/309 |
| 6,489,710 | B1 * | 12/2002 | Okita et al. | 313/309 |
| 2004/0004429 | A1 * | 1/2004 | Oh et al. | 313/495 |

* cited by examiner

*Primary Examiner*—Ashok Patel
*Assistant Examiner*—Christopher M. Raabe
(74) *Attorney, Agent, or Firm*—Bacon & Thomas, PLLC

(57) ABSTRACT

A field emission element has a gate electrode stacked on a substrate, an emitter electrode stacked on the gate electrode via an interlayer insulating layer, and an anode electrode formed on another substrate facing the emitter electrode. Further, the field emission element includes an anode pixel formed by the anode electrode and a generally rectangular fluorescent body formed thereon and a plurality of wells, each being formed in the emitter electrode and the interlayer insulating layer in a form of a narrow elongated hole. Here, the wells are disposed within a generally rectangular electron emitting area and at least a majority of the wells are arranged parallel to each other, and a length direction of the majority of the wells is substantially normal to that of the fluorescent body and the electron emitting area.

2 Claims, 13 Drawing Sheets

FIELD EMISSION ELEMENT

FIELD OF THE INVENTION

The present invention relates to a field emission element; and more particularly, to an edge emitter type field emission element.

BACKGROUND OF THE INVENTION

Recent research and development efforts on a display apparatus have been directed to reduction in a thickness of the display apparatus and energy saving. For example, there are liquid crystal display, plasma display, electric field emission type display, and the like.

So-called field emission display (hereinafter, referred to as FED for short) may be of a spindt type having a vertical configuration, or an edge emitter type having a horizontal configuration, which is referred to as a lateral type, a side type, or a planar type, depending on an array of a cathode electrode, a gate electrode, and an anode electrode.

A spindt type FED includes a substrate, a cathode electrode (emitter electrode) of an electron emission unit formed thereon having a substantially conical shape, and a gate electrode of a lead-out electrode stacked on a substrate around the cathode electrode having an insulating layer therebetween. In the spindt type FED, a voltage is applied between the cathode electrode and the gate electrode in a vacuum to thereby produce a high electric field therebetween. As a result, electrons are emitted from a tip end of the cathode electrode through the electron emission mechanism in an electric field.

In the configuration of the spindt type FED, a distance between the emitter electrode and the gate electrode is determined by a hole size provided in a resist pattern so that it is necessary to enhance accuracy in a lithography and an etching process in order to reproducibly and uniformly form the emitter electrode of an element for emitting a plurality of electrons. However, applications of these technologies largely depend on the performance of an apparatus, which cannot be controlled easily. In other words, there are inevitable problems on the fabrication caused due to miniaturization in which an electron emission characteristic varies for each element depending on the shape of the emitter electrode and the distance between the emitter electrode and the gate electrode. In particular, when producing a large-screen FED, it is difficult to uniformly form the emitter electrode on a large substrate. Therefore, unless the array of the emitter electrode is formed uniformly, the field electron emission characteristic varies depending on a position on the screen, thereby making it difficult to have a good image display on the screen.

On the other hand, the edge emitter type FED is configured such that field electrons are emitted from an emitter electrode to an anode electrode, wherein the emitter electrode is formed above a gate electrode via an insulating layer in a substantially flat sheet shape and an electric field is generated between the gate electrode and the emitter electrode to thereby cause the emitter electrode to emit electrons.

In an edge emitter type electron emission apparatus having the aforementioned configuration, electrons emitted from the emitter electrode are accelerated to collide with a fluorescent body in the same way as in the spindt type electron emission apparatus. Thus, in the FED employing the edge emitter type electron emission apparatus, the fluorescent body is excited to emit light to thereby make an image be displayed.

In such an edge emitter type FED, the edge emitter electrode for emitting electrons can be formed substantially in a flat sheet shape, and the electrons are emitted by an electric field generated between the gate electrode and the emitter electrode. Accordingly, this type of electron emission apparatus can be easily produced compared with the aforementioned spindt type FED.

The edge emitter type FED having such characteristics is applied to a field of a planar type multipole vacuum tube, and may be applied in a flat panel display by being plurally arrayed on a plane. Further, the edge emitter type FED has superior responsiveness, brightness, environment resistance, and the like, as compared with a liquid crystal display. Thus, there is a possibility for the edge emitter type FED becoming a main trend in the flat panel display, so that active research and development on a large scale planar type display apparatus have been in progress.

For resolving the aforementioned problems of the spindt type FED, Japanese patent Laid-Open Publication No. 1991-295131 (hereinafter, referred to as 'reference 1') discloses an edge emitter type field emission display element for use in a light emitting type display apparatus and the like as shown in FIG. 8, in which a lateral type emitter is thinly formed.

FIG. 8A describes a cross sectional view of a prior art field emission display element disclosed in reference 1, and FIGS. 8B to 8F show a manufacturing method thereof.

A field emission display element 100 includes an insulating plane substrate 101; pedestals 102 and 102' made of a silicon dioxide thin film and formed on a surface of the plane substrate; a cathode electrode 103 of a conductive thin film formed on the pedestals and having cathode tip 104 whose end portion is formed in an acute shape, i.e., a saw-toothed shape and from which electrons are emitted; an anode electrode 105 formed above the surface of the plane substrate and facing a cathode substrate; and a gate electrode 106 formed above the surface of the plane substrate and self-aligned with the cathode tip 104 in the cathode electrode.

As shown in FIGS. 8B to 8F, the manufacturing method includes the steps of;

forming an insulating thin film 107 made of, e.g., a insulative silicon dioxide on a surface of a plane substrate 101 (FIG. 8B);

forming a pedestal-shaped resist pattern 108 on the surface of the insulating thin film 107 (FIG. 8C);

etching the insulating thin film 107 to have a reverse tapered shape by using the resist pattern 108 as a mask, and thus, forming pedestals 102 and 102' (FIG. 8D);

forming an aluminum thin film 109 over the surface of the plane substrate by employing a directional particle beam method after removing the resist (FIG. 8E); and etching the conductive thin film 109 to form a cathode electrode 103, a gate electrode 106, and an anode electrode 105 by using a photo process (FIG. 8F).

In the prior art disclosed in reference 1, a distance between the cathode electrode and the gate electrode is controlled by a thin film thickness, so that uniform electrical characteristics can be obtained over large area. Further, it is possible to reduce the distance between both electrodes and to form the end portion of the cathode tip 104 in an acute shape, whereby a gate threshold voltage can be lowered. Meanwhile, in the aforementioned prior art, improvements have been achieved by further sharpening the cathode electrode (edge emitter electrode) and making a gap between the cathode electrode and the gate electrode small, thereby lowering a driving voltage.

Japanese patent No. 2613697 (hereinafter, referred to as 'reference 2') discloses a field emission display element having a collector electrode (anode electrode) and an edge emitter electrode (cathode electrode) in the same plane, similarly to the field emission display element disclosed in reference 1. Further, the aforementioned prior art suggests display apparatus as an electron source for display apparatus, which has a configuration that a transparent anode electrode is formed on a substrate, and a fluorescent body formed on the anode electrode is excited to emit light.

Japanese patent No. 2635879 (hereinafter, referred to as 'reference 3') discloses a planar type (edge emitter type) FED shown in FIG. 9, in contrast with the aforementioned prior arts having an edge emitter electrode and a gate electrode in the same plane.

An electron emission element 341 includes an emitter 314 and a gate 316 of a stacked structure, and an anode 343 made of a conductive thin film stacked on a transparent substrate 342. In the anode 343, there is stacked a fluorescent body 344 for slow electron beams, and the transparent substrate 342 is separated from another substrate 312 by a proper distance while facing each other. In this substrate 312, there are stacked the emitter 314 and the gate 316. In addition, the fluorescent body 344 on the transparent substrate 342 is arranged to face the gate 316.

In the electron emission element 341, a voltage is applied between the emitter 314 and the gate 316 to emit electrons and a higher voltage is applied between the emitter 314 and the anode 343 such that the electrons emitted between the emitter 314 and the gate 316 are attracted toward the anode 343 side, as indicated by an arrow A in FIG. 9. These electrons collide with the fluorescent body 344 and emit light just before reaching the anode 343.

Since the gate electrode can be stacked on the edge emitter electrode via an insulator, an edge of the edge emitter electrode can be drawn close to that of the gate electrode and an electric field can be applied efficiently to the edge of the edge emitter electrode. Further, by sharpening the edge of the edge emitter electrode, it is possible to efficiently focus an electric field from the edge emitter electrode to the sharpened tip end.

By plurally arraying such an electron emission element 341 as one pixel, a flat panel display apparatus can be obtained. In this kind of flat panel display apparatus, if the distance between the electron emission elements 341 is slightly greater than that between the emitter 314 and the gate 316, the electron emission element 314 does not affect a neighboring one, even when the electron emission element 341 forming each pixel is drawn close to the neighboring one. Further, even if pixels are closely placed each other by making a gap between the pixels small and a plurality of wires perpendicular to the transparent electrode 342 side and another substrate 312 side are formed, there is no problem such as crosstalk or the like. Therefore, it is possible to adopt a simple matrix mode as a driving mode.

Meanwhile, in a conventional planar type FED, it is difficult to deflect electrons emitted from the edge emitter electrode to a desired direction and to apply the planar type FED to a practical FED. For this, Japanese Patent Laid-Open Publication No. 1999-232997 discloses (hereinafter, referred to as 'reference 4') a four-layered electron emission element as shown in FIGS. 10 and 11, including a pair of gate electrodes; an emitter formed between the gate electrodes via insulating layers; and an auxiliary electrode formed on a bottom surface. In the four-layered FED of reference 4, an electric field generated from the auxiliary electrode does not affect the emitter electrode, whereby such a problem can be solved that the electric fields applied to the emitter electrode from the gate electrodes become relatively lowered. Further, it is possible to deflect the electrons emitted from the emitter electrode to a desired direction, and, at the same time, to have electrons emitted efficiently even at a low driving voltage.

In FIGS. 10 and 11, FED 401 includes a supporter 402, and a face plate 404 on which anode electrodes 403 are formed of a stripe shape. In the face plate 404, there are formed a red fluorescent body 405R, a green fluorescent body 405G, and a blue fluorescent body 405B, each of a rectangular shape and emitting light on the anode electrode 403. By these three colors of the fluorescent bodies, one pixel is formed of a substantially square shape (hereinafter, each fluorescent body is referred to as a sub-pixel, and an area where three colors of the fluorescent bodies are assembled is referred to as a pixel.

The FED 401 is formed on an insulating substrate 406 and arranged in a matrix form, and has a predetermined layered structure. Further, the FED 401 has an opening hole (well) 407 formed in a stacked direction of the layered structure and is of a substantially rectangular shape. From the opening hole 407, electrons are emitted.

As shown in FIG. 11, the FED 401 in the four-layered electron emission element has the insulating substrate 406 such as a glass; an auxiliary electrode 411 formed on the insulating substrate 406; a first gate electrode 413 stacked on the auxiliary electrode 411 via a first insulating layer 412; an edge emitter electrode 415 stacked on the first gate electrode 413 through a second insulating layer 414; and a second gate electrode 417 stacked on the edge emitter electrode 415 via a third insulating layer 416.

In the FED 401, the opening hole 407 goes through the first insulating layer 412, the first gate electrode 413, the second insulating layer 414, the edge emitter electrode 415, the third insulating layer 416, and the second gate electrode 417, and, at the same time, is formed to expose the auxiliary electrode 411 to a bottom surface. Further, in the FED 401, the first gate electrode 413 is configured to protrude from an opening edge of the edge emitter electrode 415 into an inner side.

By applying a predetermined voltage to the first electrode 413 and the second gate electrode 417, an electric field is generated between the first gate electrode 413, the second gate electrode 417, and the edge emitter electrode 415. Further, through the field electron emission mechanism, electrons are emitted from the tip end of the edge emitter electrode 415 in the direction of the anode electrode 405, i.e., substantially perpendicular to in-surface of the auxiliary electrode 411, and the electrons emitted from the edge emitter electrode 415 are deflected to a direction of the anode electrode 403.

Accordingly, in the FED 401, the electrons emitted from the edge emitter electrode 415 can be made to collide efficiently with the fluorescent body 405 formed on the anode electrode 403, whereby the fluorescent body 405 can efficiently emit light. Therefore, brightness of the FED can be markedly improved.

However, in the structure disclosed in reference 1, since the cathode electrode and the anode electrode are formed in the same substrate, a part corresponding to the cathode electrode cannot be a display unit. Therefore, it is difficult to be used in a high density display.

Further, in the structure disclosed in reference 3, electrons are emitted only from the tip end of the emitter and light emission becomes of a point shape such that it is difficult to uniformly emit light over the surface of a predetermined pixel. Still further, in the structure disclosed in reference 4, it is possible to improve focusing property, but there encounters a difficulty to commercialize a midsize display element due to a complicated structure thereof.

Thus, an emitter FED of a simplified structure has been studied as follows.

An edge emitter type FED is used for a midsize display element (20 to 30 inch diagonal screen), such as a television set for home use, or a display device for a personal computer having a pixel pitch in a range from about 0.6 to 1.0 mm, as mentioned in prior arts disclosed in Japanese Patent No. 2635879 and Japanese Patent Laid-Open Publication No. 1999-232997.

In the edge emitter type FED used for a midsize display element, a length direction of each sub-pixel is arranged to be parallel with that of an electron emission unit formed with an edge emitter electrode, assuming that the supporter 402 and the face plate 404 face each other, as shown in FIG. 10.

FIGS. 12A and 12B are plane view for exemplary electron emission element of a prior art developed for a midsize display device, and describe a relation of positions between fluorescent bodies 56R, 56G, and 56B, a cathode electrode 62, a gate electrode 61, and a well 59. Here, FIG. 12A is for a case having three wells and FIG. 12B is for a case having one well. Further, FIG. 13 shows a cross sectional view for a part of the electron emission element shown in FIG. 12A.

The electron emission element includes a gate electrode 52 formed on a substrate that is not shown; an insulating layer 53; a cathode electrode 54 (hereinafter, referred to as 'edge emitter electrode'); and an insulating passivation that is not shown. In addition, a fluorescent body 56 and an anode electrode 57 are disposed in an upper part of the electron emission element.

The edge emitter electrode 54 formed in a substantially planar type, in particular, an edge 58 of a tip end thereof, which emits electrons, is configured to face the gate electrode 52 of a lower side via an insulating layer 53. The edge emitter electrode 54 forms a closed rectangular shape, and a well 59 for electron emission is made of a space surrounded by the edge emitter electrode 54 and a part where the insulating layer 53 directly below the edge 58 is removed (i.e., the insulating layer is etched such that a lower part of the edge 58 in the edge emitter electrode 54 protrudes from the insulating layer 53 to thereby face the gate electrode 52).

Respective potentials of gate electrode 52 and the edge emitter electrode 54 are fed by the gate feeder unit 61 and the cathode feeder unit 62, respectively. The gate electrode 52 is disposed to be perpendicular to the edge emitter electrode 54, and the edge emitter electrode 54 forming the well 59 corresponds to one sub-pixel 56R, 56G, or 56B, having three wells as one group, in case of FIG. 12A. Further, each pixel 60 includes three sub-pixels of a red fluorescent body 56R, a green fluorescent body 56G, and a blue fluorescent body 56B as one group, and a display for displaying full colors is achieved by forming the substantially square-shaped pixel 60 in a matrix.

The electron emission element serves as a display device in such a manner that a scan signal and a data signal are inputted to the gate electrode 52 and the cathode electrode 54 from the gate feeder unit 61 and the cathode feeder unit 62, respectively, and a predetermined pixel is selected and driven to thereby have light emitted.

Further, by an electric field generated between the gate electrode 52 and the edge emitter electrode 54, electrons are emitted from the edge emitter electrode 54, and the emitted electrons are accelerated by an electric field between the gate electrode and the anode electrode to collide with the fluorescent bodies 56R, 56G, and 56B, resulting in exciting the fluorescent bodies to emit light. Meanwhile, the insulating passivation that is not shown and is formed on the edge emitter electrode 54 is for keeping an insulation with the anode electrode 57.

In the electron emission element having such a configuration, a voltage is applied between the edge emitter electrode 54 and the gate electrode 52 to thereby emit electrons. Further, when a higher voltage is applied between the edge emitter electrode 54 and the anode electrode, the emitted electrons between the edge emitter electrode 54 and the gate electrode 52 are attracted toward the anode side, as indicated by arrows in FIG. 13. These electrons collide with the fluorescent bodies 56R, 56G, and 56B to thereby emit light right before reaching the anode.

By disposing such an electron emission element to each of the red fluorescent body 56R, the green fluorescent body 56G, and the blue fluorescent body 56B, a fluorescent body unit 56 including three fluorescent bodies 56R, 56G and 56B is formed, which functions as a pixel 60. Further, a flat panel display apparatus can be formed by arraying a multiplicity of the pixels 60.

Meanwhile, in the edge emitter type FEDs shown in FIGS. 12A and 12B, and 13, electrons are emitted from the electron emission unit (edge) 58 of the ridge-shaped cathode tip end in the edge emitter electrode 54, and an amount of electrons emitted is generally determined by work function, field intensity, and electron emitting area of the edge 58. Here, the work function is determined by a material of the emitter, which is practically limited to Mo, W, C, or the like, and therefore the value of the work function is substantially fixed.

Field intensity is limited in practical use due to limitations on a withstand voltage between the cathode and the gate, a driving withstand voltage of a driver, or the like. Therefore, electron emission capacity of the edge emitter electrode 54 is determined mainly on the basis of a ridge-shaped edge length (peripheral length of the well 59) in practical use.

However, in the configurations of the prior art edge emitter electrode 54 shown in FIGS. 12A and 12B, and 13, for example, in case where there is only one well 59 corresponding to each sub-pixel in a central portion, as shown in FIG. 12B, the length of the edge 58 of the edge emitter electrode 54 in each electron emission element is short for areas of the fluorescent bodies 56R, 56B, and 56G of each pixel 60. As a result, it is difficult to have a sufficient amount of electrons emitted even for a pulse width of about Du=1/240 that is used in a graphic display, and difficult to achieve enough emission brightness even when an anode voltage applied ranges from 2 kV to 5 kV.

Meanwhile, it has been tried that a plurality of lines of wells 59 are arranged in parallel along a length direction (three lines of wells 59 are placed in each of the fluorescent bodies 56R, 56G, and 56B, in FIG. 12A) to thereby enlarge an electron emitting area, as shown in FIG. 12A.

Since the edge length along the longer side of the fluorescent body 56R, 56G, or 56B is longer than the shorter side, a large amount of electrons are emitted from the longer side, so that the longer side edge affects the surroundings significantly more than the shorter side edge.

Further, the electrons from the long edge are emitted along a direction normal to the longer side of the fluorescent body 56R, 56G, or 56B, and the electrons from the short edge are emitted along a direction parallel with the longer side of the fluorescent body 56R, 56G, or 56B.

At this time, as shown in FIG. 13, the gate electrode 52 (+) and the anode electrode (+) are placed under and above the edge emitter electrode 54 (–), and an electron emitted from the edge emitter electrode 54 is accelerated in a horizontal direction as well under the combined influence of two plus potentials. As a result, the angular spread of the electrons emitted ranges mostly within 60 degrees with respect to the cathode plane as shown in FIG. 13.

Here, since the distance from the edge 58 of the well 59 in the right side of the edge emitter electrode 54 corresponding to the fluorescent body 56R to the right side fluorescent body 56G is short and the directions of the electrons emitted are spread up to 60 degrees, electrons emitted from the well 59 are spread to be irradiated to the fluorescent body 56G as well. As a result, light corresponding to a color other than a selected one may be emitted, resulting in color mixing disorder, which is a fatal problem in a full-color display device.

Further, when the electron emission unit is made small by arranging only one well 59 in the cathode electrode as shown in FIG. 12B, the distance from the edge of the left side of the well in fluorescent body 56R to the neighboring fluorescent body 56G becomes large, as compared with the case of arranging three wells in the cathode electrode, whereby the color mixing disorder can be prevented. But, the amount of electrons emitted becomes reduced since the number of electron sources is decreased, so that high brightness cannot be obtained.

As described above, in the edge emitter type FED of a simple configuration without having a focusing electrode and without performing an anode selection, the development of a field electron emission apparatus that takes an electron path into consideration has not been successful.

SUMMARY OF THE INVENTION

It is, therefore, an object of the present invention to provide an edge emitter type FED satisfying requirements on both emission brightness and color purity, which has been difficult to be met in a prior art.

In accordance with a preferred embodiment of the present invention, there is provided a field emission element (or device) having a gate electrode stacked on a substrate, an emitter electrode stacked on the gate electrode via an interlayer insulating layer, and an anode electrode formed on another substrate facing the emitter electrode, the field emission element including: an anode pixel formed by the anode electrode and a generally rectangular fluorescent body formed thereon; and a well formed in the emitter electrode and the interlayer insulating layer in a form of a narrow elongated hole, wherein a length direction of the well is substantially perpendicular to that of the fluorescent body in the anode pixel.

In accordance with another preferred embodiment of the present invention, there is provided a field emission element having a gate electrode stacked on a substrate, an emitter electrode stacked on the gate electrode via an interlayer insulating layer, and an anode electrode formed on another substrate facing the emitter electrode, the field emission element including: an anode pixel formed by the anode electrode and a generally rectangular fluorescent body formed thereon; and a plurality of wells, each being formed in the emitter electrode and the interlayer insulating layer in a form of a narrow elongated hole, wherein the wells are disposed within a generally rectangular electron emitting area and at least a majority of the wells are arranged parallel to each other, and wherein a length direction of the majority of the wells is substantially normal to that of the fluorescent body and the electron emitting area.

Here, when overlapping the electron emitting area on the fluorescent body along a direction normal to a main surface of another substrate, a first distance between neighboring shorter sides of the electron emitting area and the fluorescent body may be greater than a second distance between neighboring longer sides of the electron emitting area and the fluorescent body.

Further, a spreading width of electrons normal to the length direction of each well may be equal to a sum of the first distance and a length of a shorter side of each well and a spreading width. of electrons along the length direction of each well substantially may equal a sum of the second distance and a length of a longer side of each well.

BRIEF DESCRIPTION OF THE DRAWINGS

The above and other objects and features of the present invention will become apparent from the following description of preferred embodiments given in conjunction with the accompanying drawings, in which:

FIGS. 2A and 2B show cross sectional views of a field emission display element in accordance with the present invention, wherein FIG. 2A is for A—A line of FIG. 1 and FIG. 2B is for B—B line of FIG. 1;

FIGS. 3A and 3B illustrate views for showing a single electrode unit of a field emission element in accordance with the present invention, wherein FIG. 3A is a cross sectional view along A—A line of FIG. 1 and FIG. 3B is a perspective view along B—B line of FIG. 1;

FIGS. 12A and 12B offer views for showing an edge emitter type FED of a prior art, wherein FIG. 12A is a plain view having three wells and FIG. 12B is a plain view having one well.

DETAILED DESCRIPTION OF THE PREFERRED EMBODIMENTS

Hereinafter, preferred embodiments of the present invention will be described in detail with reference to the accompanying drawings.

Figure 1:
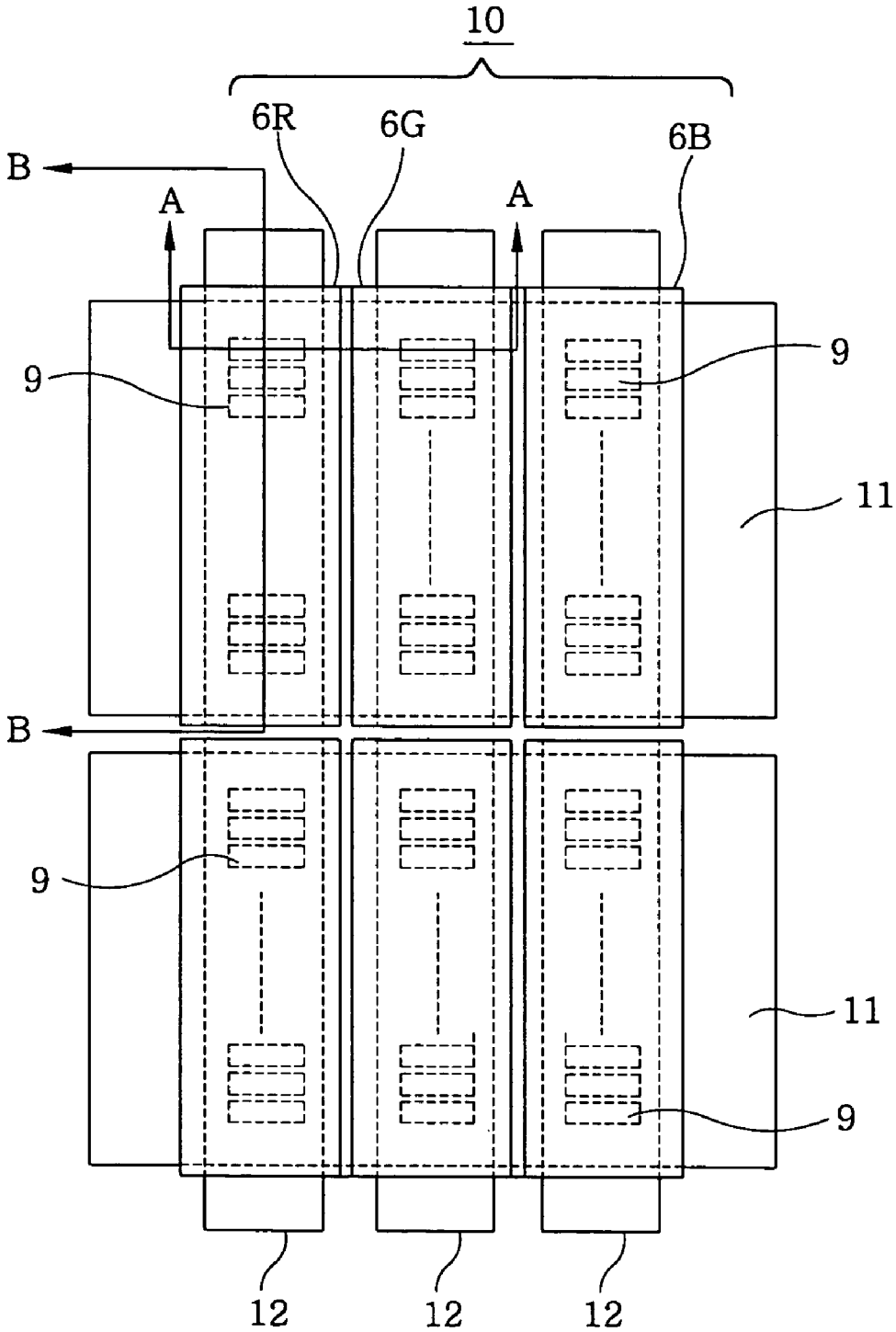
FIG. 1 is a plain view for showing one part of a field emission element (or device) in accordance with the present invention.

FIGS. 1 to 4 show a preferred embodiment of the present invention. FIG. 1 is a plain view for showing a relation between respective positions of a fluorescent body 6 (6R, 6G, and 6B), a cathode electrode 4 (cathode electrode feeder unit 12), a gate electrode 2 (gate electrode feeder unit 11), and a well 9 of a field electron emission display apparatus (hereinafter, referred to as 'FED'); FIG. 2A is a cross sectional view along A—A line of FIG. 1 and FIG. 2B is that along B—B line of FIG. 1; FIG. 3A is a cross sectional view of a single electrode unit of a field emission element along A—A line of FIG. 1 and FIG. 3B is that along B—B line of FIG. 1; and FIG. 4 describes a plain view for showing a relation of positions in an area where a cathode electrode unit and the fluorescent body (sub-pixel) occupy.

The FED of the present invention will be explained in detail with reference to FIGS. 1 to 4.

The FED includes a gate electrode 2 formed on a supporter 1 of a cathode side, an interlayer insulating layer 3, a cathode electrode 4 (hereinafter, referred to as 'emitter electrode'), and an insulating passivation 5, which are sequentially stacked. In addition, a plurality of electron emission units 20, each having a well 9 formed of a closed opening by an edge 8 of the emitter electrode 4, is placed in the FED. In an upper part of the FED, there are disposed a fluorescent body 6 (i.e., corresponding to one group of a luminous body formed by three fluorescent bodies, i.e., a red fluorescent body 6R, a green fluorescent body 6G, and a blue fluorescent body 6B), which is formed on a supporter 1 of an anode side, and an anode electrode 7. Each of the red fluorescent body 6R, green fluorescent body 6G, and blue fluorescent body 6B is referred to as a sub-pixel, and three sub pixels 6 become one group to thereby form a substantially square-shaped pixel 10. A plurality of pixels 10 is disposed in a matrix.

As a material for color of the fluorescent body 6, there are, e.g., $Y_2SiO_5$:Tb (green), $Y_2SiO$:Ce (blue), $Y_2O_3$:Eu (red), and the like.

In the electron emission unit 20, the well 9 for electron emission is formed by an opening of the emitter electrode 4 having a closed rectangular shape whose inner periphery is the edge 8 of the emitter electrode 4; a groove formed on the gate electrode 2 by etching the interlayer insulating layer 3 right below the opening; and a part where the insulating layer 3 directly below the edge 8 is removed (the insulating layer 3 is etched such that the lower portion of the edge 8 in the emitter electrode 4 protrudes from the insulating layer 3 to thereby face the gate electrode 2).

Figure 3A:
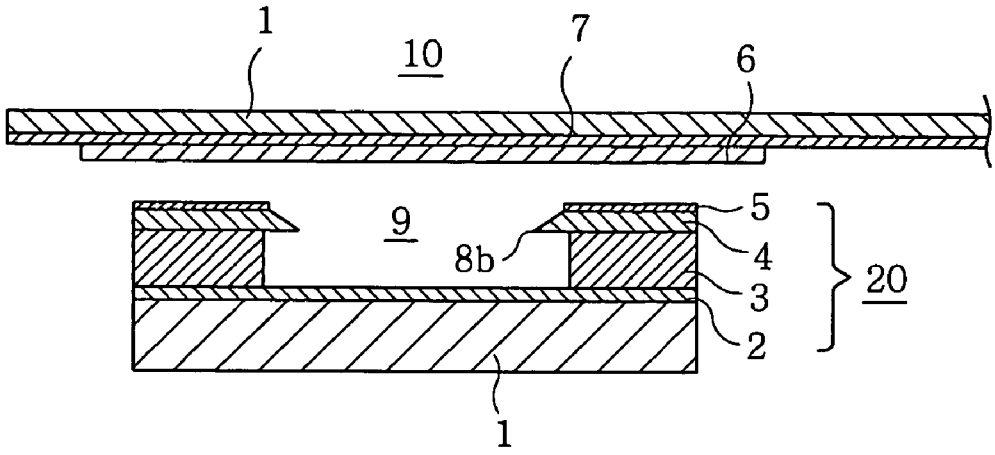
Figure 3B:
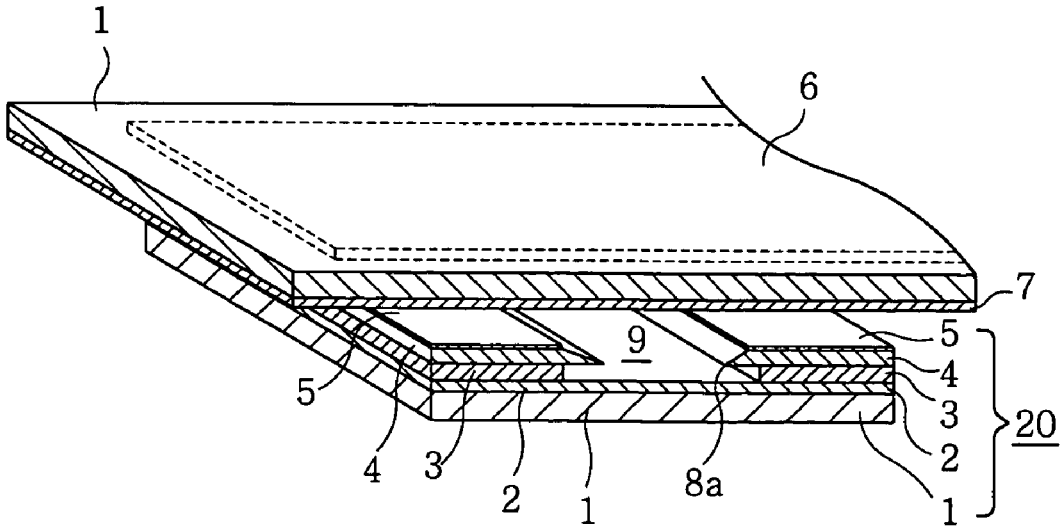

As is clear from FIG. 3A, the well 9 is formed so as to go through the interlayer insulating layer 3, the edge emitter electrode 4, and the insulating passivation 5, and, at the same time, to expose the gate electrode 2 on a bottom surface.

Further, as known from FIG. 1, there are formed pluralities of wells 9, each having the rectangular-shaped opening in the cathode electrode units 20 such that a length direction thereof is perpendicular to that of each of the rectangular fluorescent bodies 6R, 6G, and 6B.

Figure 4:
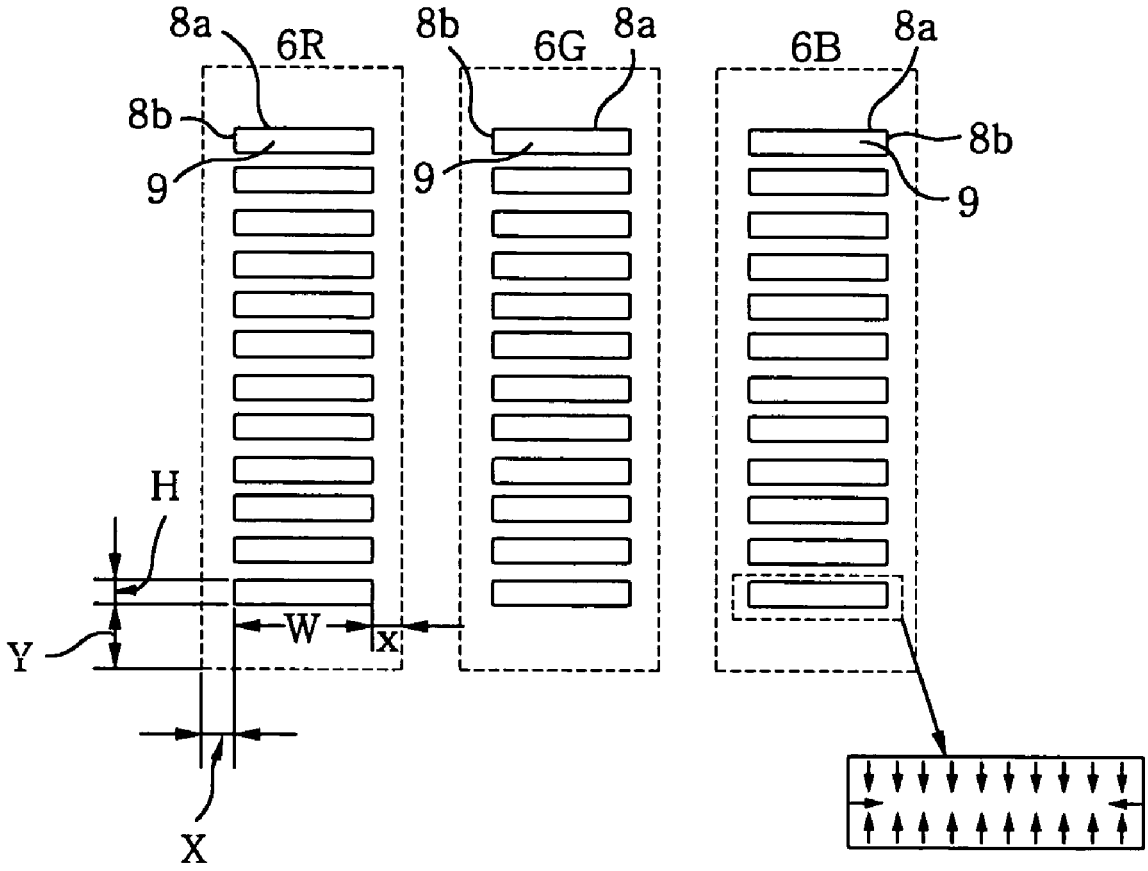
FIG. 4 describes a plain view for showing a relation of positions in an area where a range for forming a well in a cathode electrode unit is overlapped with that for forming a fluorescent body (sub-pixel)

Still further, as shown in FIG. 4, assuming that a range where one or more wells 9 are formed is one area, this one area becomes a range for forming the emitter electrode 4, in the sub-pixel area formed by each fluorescent body 6 (6R, 6G, or 6B). At this time, in an area where the range for forming the emitter electrode 4 is not overlapped with that for forming the fluorescent body 6 (6R, 6G, or 6B), it is configured such that a width X of an area where color selecting directions are not overlapped with each other is narrow, and a width Y of an area where same color directions are not overlapped with each other is wider than the width X.

That is, in the area where the range for forming the emitter electrode 4 is not overlapped with that for forming the fluorescent body 6 (6R, 6G, or 6B), a sum of the width X of an area where color selecting directions are not overlapped with each other and a width W of a longer side of the well 9 is configured to match with a spreading width $E_x$ of the emitted electrons. Further, a sum of the width Y of an area where same color directions are not overlapped with each other and a width H of a shorter side of the well 9 is equal to the spreading width $E_y$ of the emitted electrons. Still further, the spreading width E ($E_x$ or $E_y$) means a plane distance between the edge 8 and an end portion of the fluorescent body that emits light by irradiation of the electron emitted from the edge 8.

The gate electrode 2 and the emitter electrode 4 are electrically connected to the gate feeder unit 11 and the cathode feeder unit 12, respectively, and disposed normal to each other.

If a voltage is applied to each electrode, the edge 8 of a tip end in the emitter electrode 4 emits electrons.

The electron emission element 20 serves as a display device in such a manner that a scan signal and a data signal are inputted from the gate feeder unit 11 and the cathode feeder unit 12 to the gate electrode 2 and the cathode electrode 4, respectively, and a predetermined pixel is selected and driven, whereby emitted electrons ($e^-$) collide with the fluorescent body to emit light.

Figure 2A:
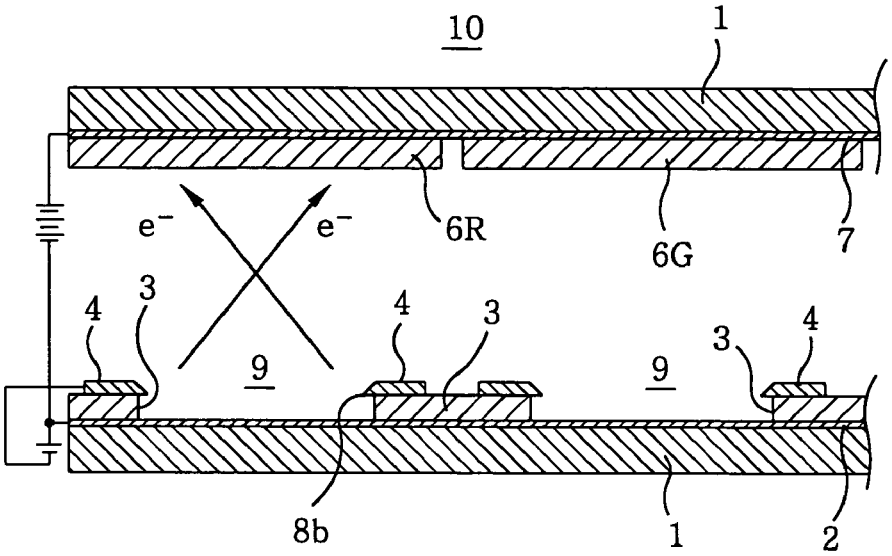
Figure 2B:
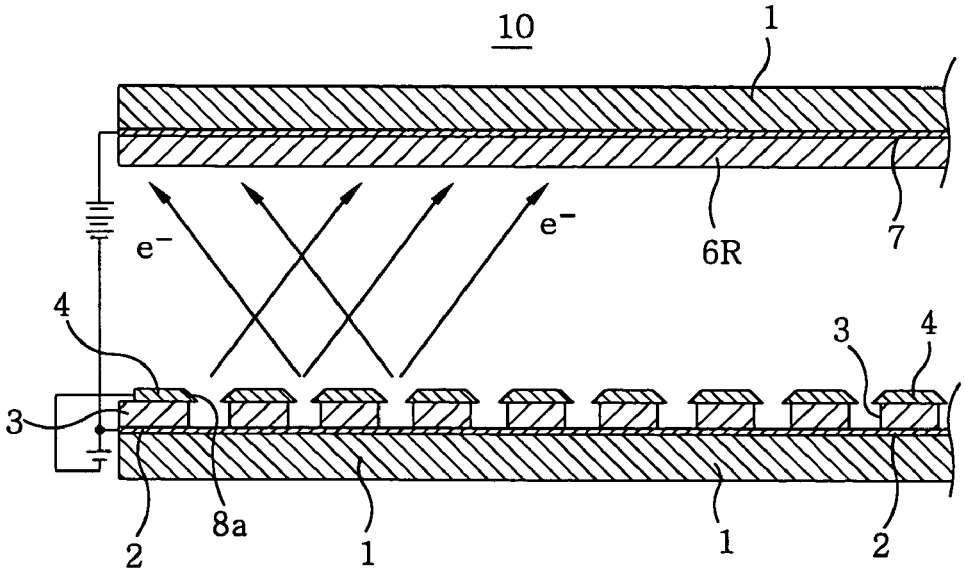

Further, the electrons ($e^-$), which are emitted from the emitter electrode 4 by an electric field generated between the gate electrode 2 and the emitter electrode 4, are emitted along an inclined direction under an influence of the emitter electrode 4, as shown in FIGS. 2A and 2B. And, the emitted electrons ($e^-$) excite the fluorescent bodies 6R, 6G, and 6B formed on the anode electrode 7 to thereby emit light. Meanwhile, the insulating passivation 5 on the upper surface of the emitter electrode 4 is for keeping an insulation from the anode electrode 7.

In such an electron emission element 20, an electric field is generated between the gate electrode 2 and the emitter electrode 4 to emit electrons ($e^-$), by applying a predetermined voltage to the gate electrode 2. Further, if a higher voltage is applied between the emitter electrode 4 and the anode electrode, the electrons ($e^-$) emitted between the emitter electrode 4 and the gate electrode 2 are attracted toward the anode side along an inclined direction, as indicated by arrows in FIGS. 2A and 2B. Thus, by so-called field electron emission mechanism, these electrons are emitted toward the anode electrode 7, and the electrons emitted from the emitter electrode 4 are deflected toward the anode electrode 7. Theses electrons collide with the fluorescent bodies 6R, 6G, or 6B to thereby emit light right before reaching the anode.

By disposing such an electron emission element 20 to each of the red fluorescent body 6R, the green fluorescent body 6G, and the blue fluorescent body 6B shown in FIG. 1, one pixel 10 can be obtained. Further, a flat panel display apparatus can be obtained by arraying a plurality of the pixels 10.

Next, a first special configuration of the present invention will be mentioned, wherein a length direction of the well 9 is perpendicular to that of the fluorescent body 6 (6R, 6G, or 6B).

In each pixel 10, the electrons ($e^-$) are emitted along the inclined direction with a spread angular distribution as indicated by arrows in FIGS. 2A and 2B. Further, as shown in FIG. 4, there is a big difference between the amount of electrons emitted, as indicated by the number of arrows, from a longer side edge 8*a* of the length direction and that from a shorter side edge 8*b* of a short direction of the edge 8.

In the electron emission element 20 facing the fluorescent body 6R shown in FIG. 2A, there are described a cross section of the emitter electrode 4 in a direction parallel to the longer side of the rectangular-shaped opening; a cross section of the groove in a length direction of the well 9; and the shorter side edge 8*b* in a direction of the short direction of the edge 8.

In a plurality of electron emission elements 20 facing the fluorescent body 6R shown in FIG. 2B, there are displayed a cross section of the emitter electrode 4 in a direction perpendicular to the longer side of the rectangular-shaped opening; a cross section of the groove in a short direction of the well 9, and the longer side edge 8*a* in the length direction of the edge 8.

The electrons ($e^-$) emitted from the four sides of the emitter electrode 4, i.e., the longer side edges 8*a* and the shorter side edges 8*b*, are emitted at respective tilted angles with respect to the cathode side supporter 1, as shown in FIGS. 2A and 2B, and 4. Further, a direction of an arrow shown in FIGS. 2A and 2B represents a spread angular distribution of the emitted electrons ($e^-$), and the number of arrows in FIG. 4 is proportional to the amount of electrons emitted.

Meanwhile, the spreading width E ($E_x$ or $E_y$) of the emitted electrons means a plane distance between the edge 8 and an end portion of the fluorescent body that emits light by irradiation of the electron emitted from the edge 8.

Figure 13:
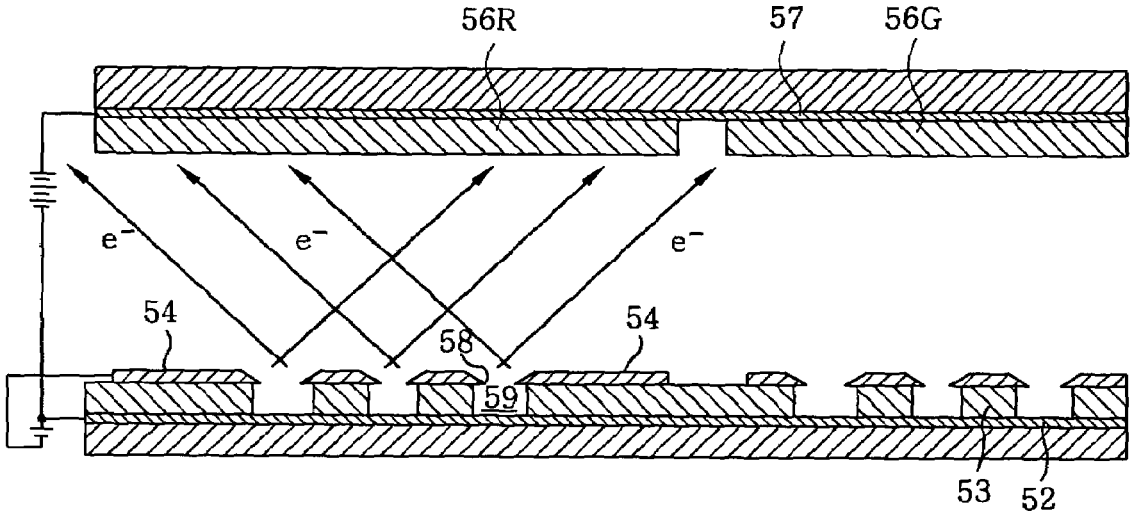
FIG. 13 (PRIOR ART)
FIG. 13 provides a cross sectional view of an edge emitter type FED of a prior art shown in FIG. 12A.

In particular, the electrons ($e^-$), which are emitted from the longer side edge 8*a* of the length direction of the rectangular-shaped well 9, are accelerated in a horizontal direction as well under the combined influence of plus potentials of the gate electrode 2 and the anode electrode 7, which are respectively placed above and under a minus potential of the emitter electrode 4 (referring to FIG. 13). As a result, the electrons ($e^-$) are emitted with a spread angular distribution that is proportional to a width of the cathode electrode. Further, the electrons emitted from the shorter side edge 8*b* of the short direction in the rectangular-shaped well 9, are under the same influence as above.

Meanwhile, an electron emitting area of the shorter side is smaller than that of the longer side, so that the amount of electrons emitted from the shorter side becomes small as compared with that of the longer side.

In FIG. 2A, if the angular distribution of the electrons ($e^-$) emitted from the shorter side edge 8*b* indicated by the arrow in FIG. 2A is spread widely, the emitted electrons may reach into the neighboring fluorescent body 6G. As a result, color mixing disorder between the adjacent pixels is caused, emission brightness is lowered, and color purity becomes deteriorated.

In accordance with the present invention, the amount of electrons emitted from the shorter side edge 8*b* is small, as shown in FIG. 4; there is no electron reaching into the neighboring fluorescent body 6G; color mixing disorder is prevented; emission brightness is enhanced; and color purity becomes improved.

Further, in FIG. 2B, the amount of electrons ($e^-$) emitted from the longer side edge 8*a* indicated by the arrows is large and the emitted electrons always excite the rectangular red fluorescent body 6R. Therefore, the brightness of the emitted light is enhanced and color purity becomes maintained.

Next, a second special configuration of the present invention will be explained. A field emission element in accordance with the present invention may include a plurality of wells, each being formed in the emitter electrode and the interlayer insulating layer in a form of a narrow elongated hole. Wherein the wells are disposed within a generally rectangular electron emitting area and at least a majority of the wells are arranged parallel to each other, and a length direction of the majority of the wells is substantially normal to that of the fluorescent body and the electron emitting area.

If the electron emitting area is overlapped on the fluorescent body along a direction normal to a main surface of said another substrate, a first distance between neighboring shorter sides of the electron emitting area and the fluorescent body is greater than a second distance between neighboring longer sides of the electron emitting area and the fluorescent body.

Further, a spreading width of electrons normal to the length direction of each well is equal to a sum of the first distance and a length of a shorter side of each well and a spreading width of electrons along the length direction of each well substantially equals a sum of the second distance and a length of a longer side of each well.

Hereinafter, a second special configuration of the present invention will be discussed more specifically. In the area where the range for forming the well 9 of the emitter electrode 4 is not overlapped with that for forming the fluorescent body 6 (6R, 6G, or 6B), it is configured such that the width X of an area where color selecting directions are not overlapped with each other and the width Y of an area where same color directions are not overlapped with each other is wider than the width X.

In accordance with the present invention, the range for forming the well placed inside the emitter electrode is formed to prevent the color mixing disorder and maintain color purity, based on the characteristic that the electrons are emitted in the inclined direction with a spread angular distribution since the emitted electrons ($e^-$) are accelerated in the horizontal direction as well in proportion to the width of the electrode under an influence of a potential of the emitter electrode.

In FIGS. 1 to 4, assuming that E ($E_x$ or $E_y$) means the spreading width of the electrons emitted from the edge 8 of the well 9, W refers to a width of the longer side edge 8*a* of the well 9, and H is a width of the shorter side edge 8*b*, each of E, W, H, X, and Y should satisfy an equation 1 as is defined below in order that the electron ($e^-$) emitted from the shorter side edge 8*b* of the left side in the fluorescent body 6R does not reach into the neighboring fluorescent body 6G, and, at the same time, the electron ($e^-$) emitted from the longer side edge 8*a* of the upper side does not reach into the neighboring fluorescent body 6R in the same color direction, which is disposed under the fluorescent body 6R shown in FIG. 1, and light emission is performed uniformly;

$$E_x=W+X,\ E_y=Y+H,\ \text{and}\ X<Y\ (\text{here},\ H<W\ \text{and}\ E_x=E_y) \quad \text{[equation 1]}$$

As shown in FIG. 4, in the area where the range for forming the fluorescent body making the pixel 10 is not overlapped with that for forming the corresponding well 9

(width of the longer side=W) of the emitter electrode, it is configured such that the width X of an area where color selecting directions are not overlapped with each other is narrow and the width Y of an area where same color directions are not overlapped with each other is wider than the width X, for the spreading width E ($E_x$ or $E_y$) of the electrons emitted from the edge 8. Accordingly, overlapping of the color selecting directions are prevented, color purity is maintained, image quality is improved, and the electrons are uniformly emitted to in-surface of corresponding fluorescent body. Therefore, emission brightness can be enhanced.

Figure 12A:
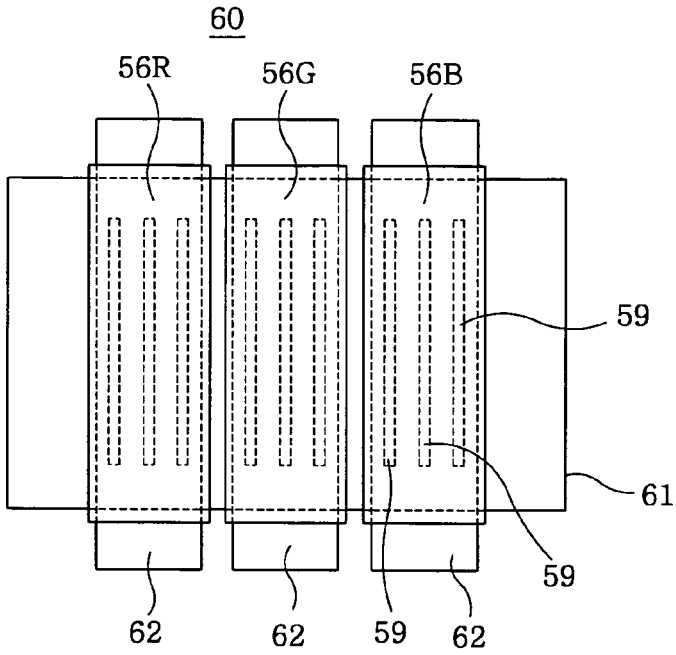
FIG. 12A (PRIOR ART)
Figure 12B:
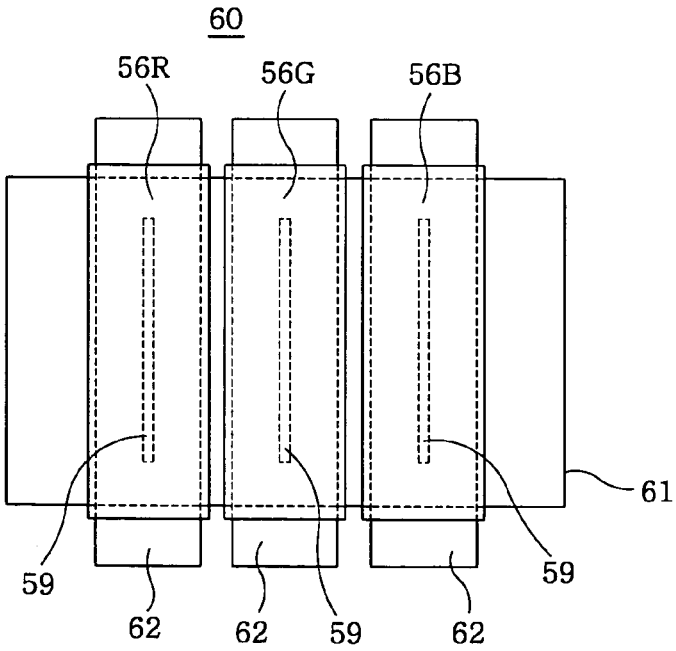
FIG. 12B (PRIOR ART)

In accordance with the configuration of the present invention, it is possible to make the distance from the shorter side edge 8*b* of the left side in the well 9 corresponding to fluorescent body 6R, as shown in FIG. 2A, to the neighboring fluorescent body 6G large, as compared with the distance from the edge of the left side in the well to the neighboring fluorescent body 56G in the conventional FED having one well in a central portion of the cathode electrode shown in FIG. 12B. As a result, there is no electron reaching into the neighboring fluorescent body 6G to thereby prevent color mixing disorder between the adjacent pixels and color purity is maintained. In other words, it is configured such that the sum of the width X of an area where color selecting directions are not overlapped with each other and the width W of the longer side edge 8*a* is equal to the spreading width $E_x$ of the emitted electrons (i.e., satisfying $E_x$=W+X).

Further, in accordance with the present invention, as shown in FIG. 2B, it is possible to array the longer side edges 8*a* emitting the large amount of electrons very densely, and the sum of the width Y of an area where same color directions are not overlapped with each other and the width H of the shorter side edge 8*b* is equal to the spreading width $E_y$ of the emitted electrons (i.e., satisfying $E_y$=Y+H, and X<Y). Therefore, the electrons can be uniformly emitted to the fluorescent body corresponding to the width Y, and the amount of electrons emitted can be increased for one pixel. Further, emission brightness can be enhanced, and image quality becomes sharpened. Meanwhile, the well 9 may be placed such that the electrons are irradiated to an area between pixels where the fluorescent body is not formed.

Figure 5:
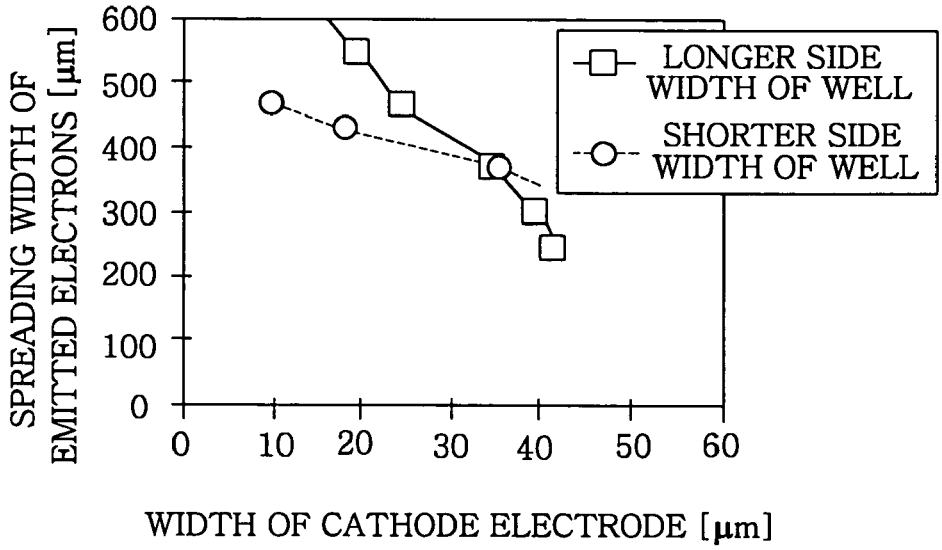
FIG. 5 offers a graph for showing a variation of a spreading width of emitted electrons as a function of a width of a cathode electrode, for a longer side width and a shorter side width of a well.

FIG. 5 is a graph for showing a variation of a distance (μm) of an emitting area, i.e., the spreading width E ($E_x$ or $E_y$) of the emitted electrons as a function of the width of the cathode electrode 4 in the single edge 8 (single well 9), for the longer side width W and the shorter side width H of the well.

Here, the width of the cathode electrode (well width) is shown as a parameter, defining "longer side of the well" as an emission area for the electron emission from the direction of the longer side edge 8*a* and "shorter side of the well" as an emission area for the electron emission from the direction of the shorter side edge 8*b*.

This graph shows that a variation of the electron spreading for the cathode electrode in the longer side of the well is slightly larger than the other, but in an absolute value of the spreading width, the longer side is equal to the shorter side. As shown in FIGS. 2A and 2B, and 4, it is configured such that the electrons from the longer side edge 8*a* are emitted along the longer side direction of the fluorescent body 6R with a spread angular distribution, and the sum (H+Y) of the width H of the shorter side edge 8*b* and the width Y is equal to the spreading width $E_y$ of the emitted electrons. As a result, the emitted electron always excites the fluorescent body 6R, the electron spreading improves emission brightness, color purity is maintained, and image quality can be sharply maintained.

Further, the electron emitted from the shorter side edge 8*b* is emitted along the shorter side direction of the fluorescent body 6R. In this direction, the distance from the fluorescent body 6R to the neighboring fluorescent body 6G is long, and a relation of $E_x$=W+X is satisfied. Therefore, there is no electron leaking into the neighboring body 6G, color mixing disorder between the adjacent pixels is prevented, emission brightness becomes high, and color purity is maintained.

As is clear from the experimental result shown in FIG. 5, in an area where the range for forming the well 9 of the emitter electrode 4 is not overlapped with that for forming the fluorescent body 6, by making the width X of an area where color selecting directions are not overlapped with each other narrow, and making the width Y of an area where same color directions are not overlapped with each other wide, irradiation of the electron can be uniformly performed over the surface.

Figure 6:
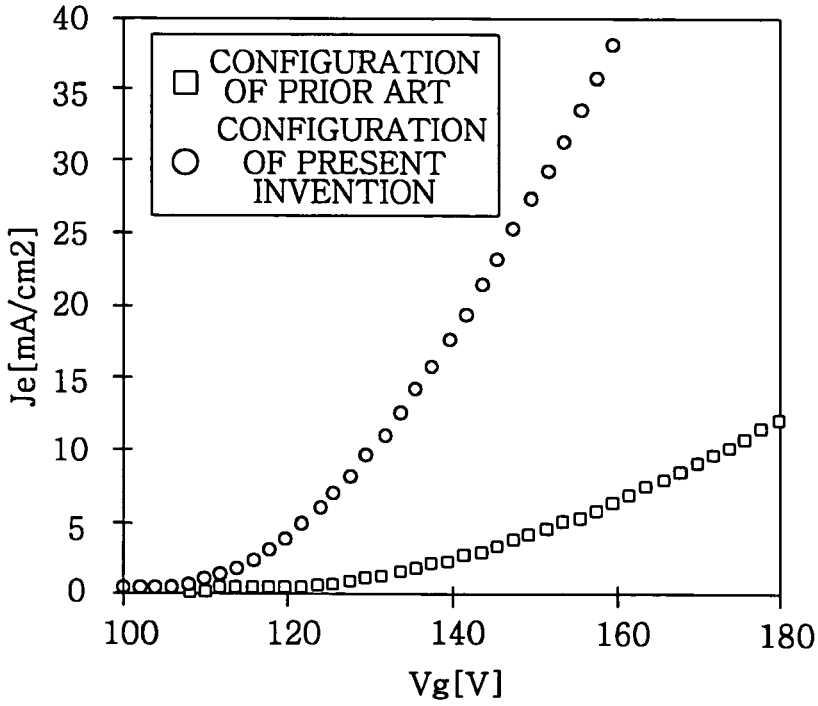
FIG. 6 provides a graph for comparing a current emission characteristic in a configuration of a prior art with that of the present invention.

The effects of the configuration in accordance with the present invention, as mentioned above, are clear from the experimental result shown in FIG. 6.

FIG. 6 is a graph for comparing the amount of electrons emitted in the configuration of a prior art with that of the present invention, as an anode current density Je (mA/cm$^2$) as a function of a gate voltage Vg (V).

For example, in case of Vg=140 V, a current density in the conventional configuration is about 3 mA/cm$^2$, but in the present invention, six times of the conventional current density, i.e., about 17 mA/cm$^2$, can be obtained. Meanwhile, the length of the edge in the edge emitter becomes six times.

According to the aforementioned experimental results, light emission can be confirmed at Vg=140 V in case of the conventional configuration, but can be confirmed even at Vg=110 V in case of the configuration of the present invention, owing to an effect of the increase in the amount of electrons emitted resulted from the increase in the edge length of the edge emitter. Further, two line-shaped emission parts are observed lengthwise at Vg=180 V in case of the conventional configuration, so that in-pixel uniformity of emission brightness becomes bad. On the other hand, it can be observed that entire pixels are uniformly emitting light at Vg=160 V in case of the configuration of the present invention. Still further, it can be noted that the color mixing disorder does not occur between the adjacent pixels.

A manufacturing method of the present invention is a thin film forming processing same as that of the spindt type.

The manufacturing method of the present invention is shown by step, as follows;

forming a gate film (Nb);

coating a resist, exposing a gate pattern, development, and etching;

forming an insulating layer ($SiO_2$);

forming a cathode film (Nb, Mo);

coating a resist, exposing a cathode line pattern, development, and etching; and coating a resist, exposing a well pattern, development, and etching the gate film (Nb) and the insulating layer;

Further, the manufacturing method of the present invention has no difference in the steps, as mentioned above. But, there is a difference in each step, and it will be explained, hereinafter.

In the spindt type (electric field focus type) cathode electrode, 'minimization' becomes an important technical problem, i.e., sharpening the emitter so as to increase field intensity for the emitter and making the distance between the emitter and the gate small.

From the point of view for a thin film forming technology, in case of forming a desired configuration with a thin film, in general, a pattern of a planar direction is formed by way of a photolithography and a thickness (length) direction is designed as a film thickness for forming a film.

Here, the photolithography is easily performed when a resolution is rough, but film forming and etching are easily performed as the film thickness for forming a film is thin.

In case of the photolithography, it is difficult to form a large area with a resolution of 1 μm order. However, if the film thickness is more than 1 μm, it is difficult to form and etch the film.

In other words, when forming a thin film, in a planar direction, the forming can be easily performed when the resolution is rough while in the length direction, the forming can be performed easily when the film thickness is thin.

In a vertical type FED such as spindt type, the distance between the gate and the emitter is determined by resolution of the photolithography and the emitter is formed lengthwise, so that a film should be formed thick or an etching should be performed deeply.

Conclusively, in the vertical type FED, it is difficult to perform a film forming and etching, due to the configuration thereof.

However, in the edge type cathode of the planar type in accordance with the present invention, the distance between the gate and the emitter is determined by a film thickness of an interlayer insulating layer, and the resolution of the photo does not affect the basic electron emission characteristic.

Further, the emitter is a lateral (planar) type, so that it is formed with a thin film thickness for forming a film.

As described above, in the FED of the present invention, the photolithography, film forming, etching, and the like are easily performed when designing the configuration and the manufacturing method, as compared with the spindt type FED.

Figure 7A:
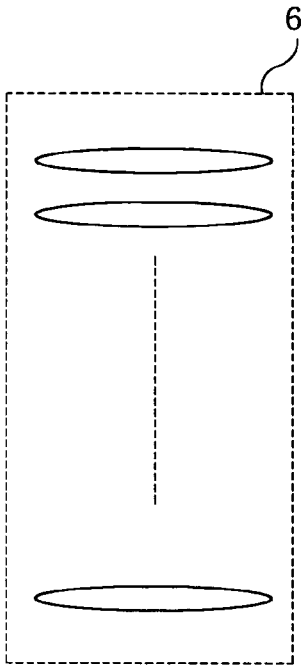
FIGS. 7A to 7C present types of a well in accordance with another preferred embodiment of the present invention.
Figure 7B:
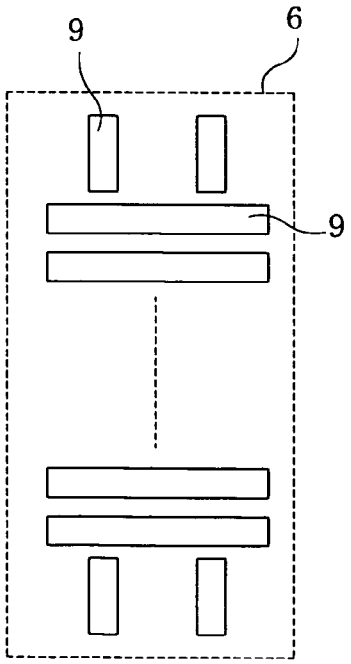
Figure 7C:
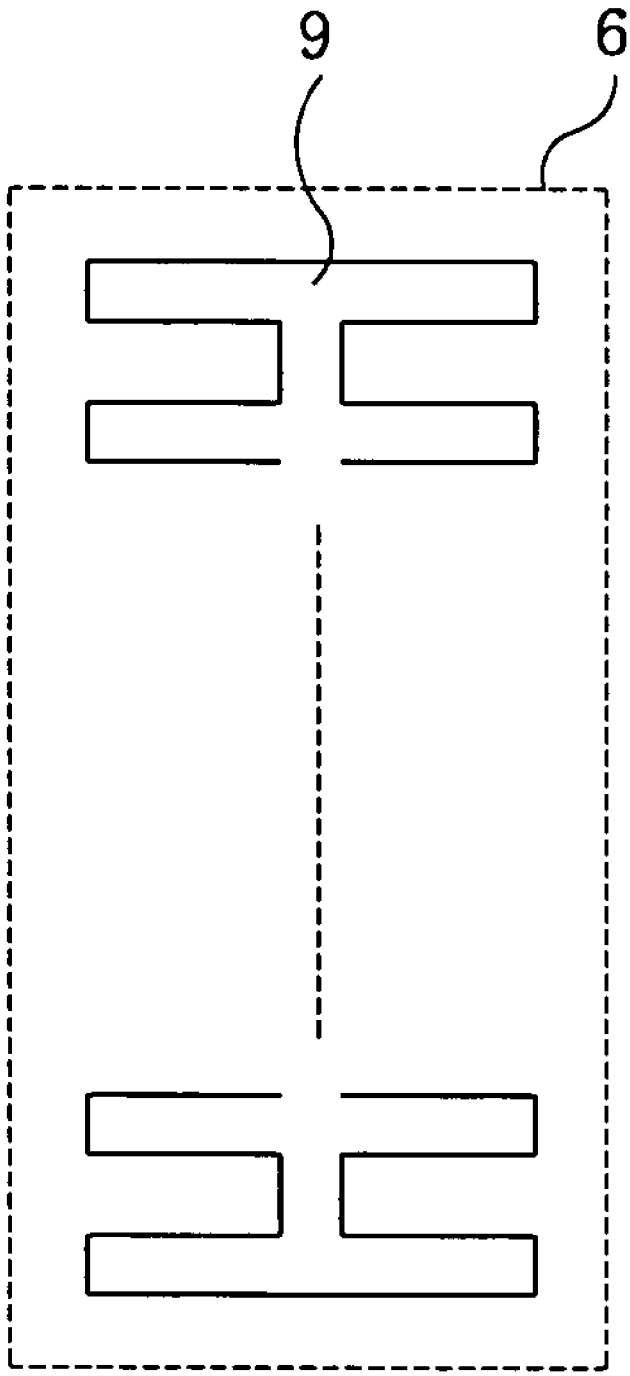
Figure 8A:
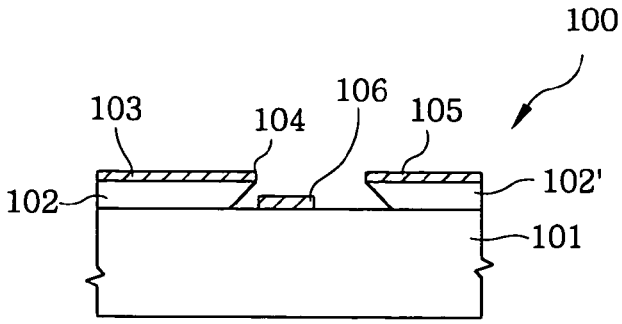
FIG. 8A (PRIOR ART)
FIG. 8A depicts a cross sectional view of a horizontal FED (field emission display) of a prior art disclosed in reference 1.
Figure 8B:
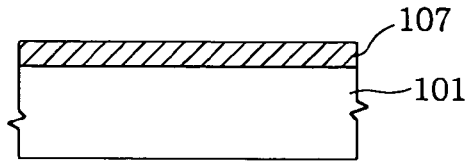
FIG. 8B (PRIOR ART)
FIGS. 8B to 8F represent manufacturing processes thereof.
Figure 8C:
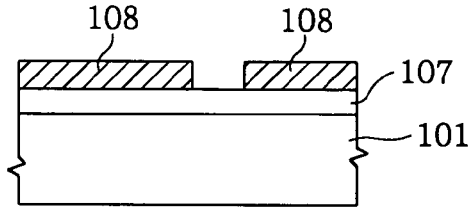
FIG. 8C (PRIOR ART)
Figure 8D:
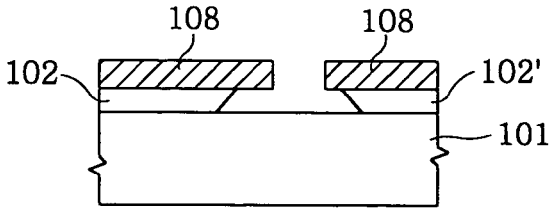
FIG. 8D (PRIOR ART)
Figure 8E:
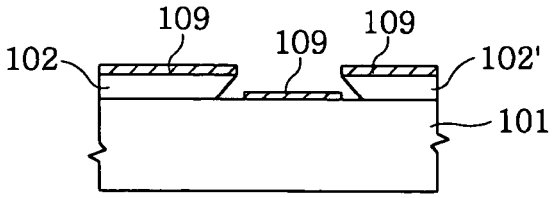
FIG. 8E (PRIOR ART)
Figure 8F:
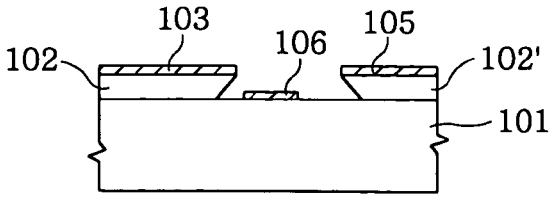
FIG. 8F (PRIOR ART)
Figure 9:
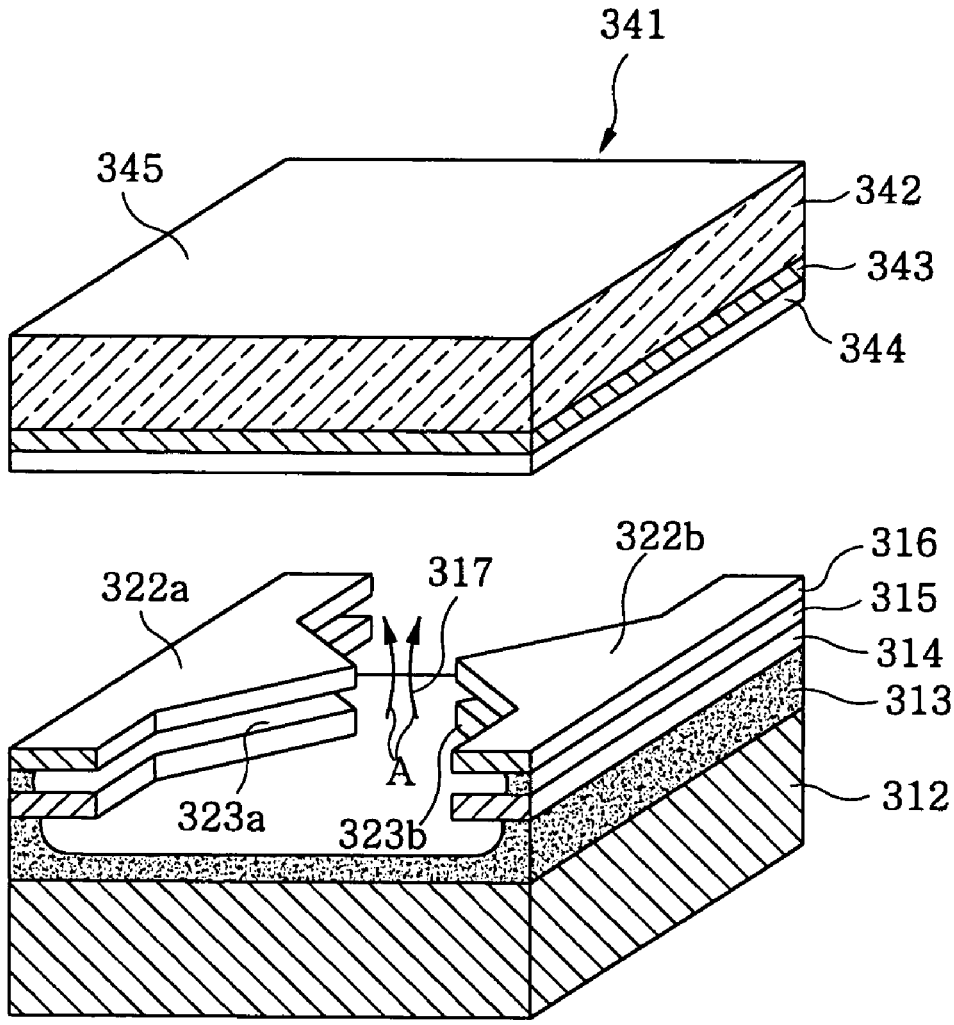
FIG. 9 (PRIOR ART)
FIG. 9 sets forth a cross sectional perspective view of an FED of a prior art disclosed in reference 3.
Figure 10:
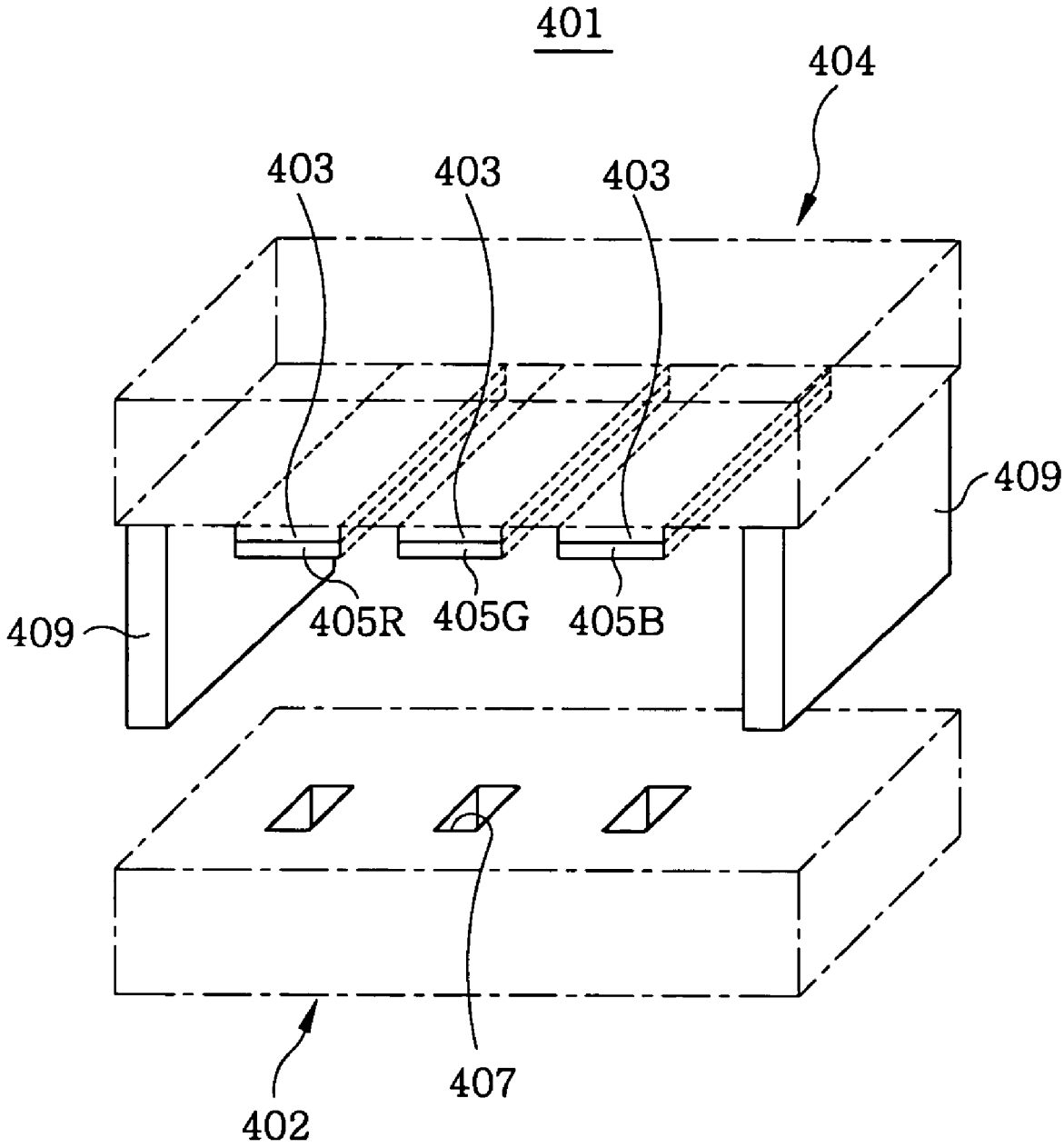
FIG. 10 (PRIOR ART)
FIG. 10 is a perspective view for showing one pixel in an FED electrode of a prior art disclosed in reference 4.
Figure 11:
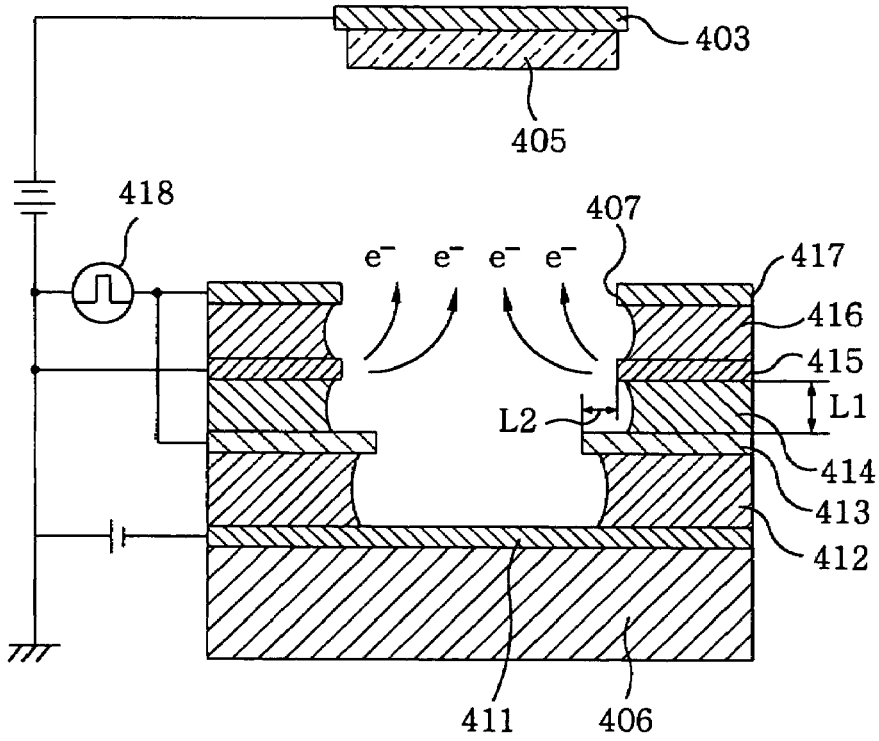
FIG. 11 (PRIOR ART)
FIG. 11 describes a cross sectional view of an FED electrode of a prior art disclosed in reference 4.

Meanwhile, the shape of the well 9 (the opening of the cathode electrode) of the present invention may be formed in an elliptical shape shown in FIG. 7A, other than FIG. 1. In addition, such a configuration may be allowed that the main part of the electron emission unit 20 has the same configuration as that of the present invention and conventional wells are disposed above and under the main part (FIG. 7B), and the configuration of the present invention may be combined with that of the prior art (FIG. 7C).

While the invention has been shown and described with respect to the preferred embodiments, it will be understood by those skilled in the art that various changes and modifications may be made without departing from the spirit and scope of the invention as defined in the following claims.

What is claimed is:

1. A field emission element having a gate electrode stacked on a substrate, an emitter electrode stacked on the gate electrode via an interlayer insulating layer, and an anode electrode formed on another substrate facing the emitter electrode, the field emission element comprising: an anode pixel formed by the anode electrode and a generally rectangular fluorescent body formed thereon; and a plurality of wells, each being formed in the emitter electrode and the interlayer insulating layer in a form of a narrow elongated hole, wherein the wells are disposed within a generally rectangular electron emitting area and at least a majority of the wells are arranged parallel to each other, wherein a length direction of the majority of the wells is substantially normal to that of the fluorescent body and the electron emitting area, and the majority of wells generally form a line, and wherein when overlapping the electron emitting area on the fluorescent body along a direction normal to a main surface of said another substrate, a first distance between neighboring shorter sides of the electron emitting area and the fluorescent body is greater than a second distance between neighboring longer sides of the electron emitting area and the fluorescent body.

2. The field emission element of claim 1, wherein a spreading width of electrons normal to the length direction of each well is equal to a sum of the first distance and a length of a shorter side of each well and a spreading width of electrons along the length direction of each well substantially equals a sum of the second distance and a length of a longer side of each well.

* * * * *